US006688086B2

(12) United States Patent
Foerderer

(10) Patent No.: US 6,688,086 B2
(45) Date of Patent: Feb. 10, 2004

(54) CINCH BUCKLE AND METHOD OF USE

(75) Inventor: Gerald R. Foerderer, Wimbledon, ND (US)

(73) Assignee: Weaver Leather Goods, Inc., Mt. Hope, OH (US)

( * ) Notice: Subject to any disclaimer, the term of this patent is extended or adjusted under 35 U.S.C. 154(b) by 0 days.

(21) Appl. No.: 10/096,686

(22) Filed: Mar. 12, 2002

(65) Prior Publication Data

US 2003/0000183 A1 Jan. 2, 2003

Related U.S. Application Data

(60) Provisional application No. 60/275,798, filed on Mar. 14, 2001.

(51) Int. Cl.[7] ..... B68C 1/00
(52) U.S. Cl. ..... 54/23; D30/139
(58) Field of Search ..... 54/23, 27, 46.1, 54/79.2; D30/139; D11/200, 201; 24/307, 325

(56) References Cited

U.S. PATENT DOCUMENTS

| | | | | | |
|---|---|---|---|---|---|
| 29,279 | A | * | 7/1860 | Moore | D30/139 |
| 449,492 | A | * | 3/1891 | McFarlane | 54/23 |
| 760,885 | A | * | 5/1904 | Loos | 24/325 |
| 1,503,715 | A | * | 8/1924 | Schnitger | 54/23 |
| 2,230,070 | A | * | 1/1941 | Wilhelm | 54/23 |
| 3,641,739 | A | | 2/1972 | Stubben | 54/46.1 |
| 4,184,452 | A | * | 1/1980 | Buzzell et al. | 119/654 |
| 4,324,090 | A | | 4/1982 | Nix | 54/46.1 |
| 5,031,387 | A | * | 7/1991 | Rider | 54/23 |
| 5,065,773 | A | * | 11/1991 | Jackson et al. | 482/106 |
| 5,125,219 | A | | 6/1992 | Sligo | 54/23 |
| 5,216,874 | A | | 6/1993 | Farrow | 54/46.1 |
| 5,226,282 | A | | 7/1993 | Meyers | 54/23 |
| 5,816,031 | A | * | 10/1998 | Marshall | 54/23 |
| D419,269 | S | * | 1/2000 | Martin | D30/139 |
| 6,530,128 | B2 | * | 3/2003 | Bunjes et al. | 24/307 |

* cited by examiner

*Primary Examiner*—Charles T. Jordan
*Assistant Examiner*—Elizabeth Shaw
(74) *Attorney, Agent, or Firm*—Sand & Sebolt

(57) ABSTRACT

A cinch and a buckle therefore and a method for tightening and securing the cinch about the body of a horse to secure a saddle on the horse. The buckle has a rigid frame with a base bar, an intermediate bar and an outer bar extending between a pair of side frame members. The intermediate bar forms a pair of intervening apertures with the outer and base bars for receiving a free end of a cinch strap looped therethrough. The intermediate and outer bars have roller sleeves mounted thereon to reduce the sliding friction of the strap moving about the bars when tightening the cinch about the horse. A locking tongue is attached to the base bar and extends through a selected hole in the strap and lays against the intermediate bar to secure the cinch and strap in an adjusted tightened position.

39 Claims, 4 Drawing Sheets

CINCH BUCKLE AND METHOD OF USE

CROSS REFERENCE TO RELATED APPLICATION

This application is a standard utility which claims priority from U.S. Provisional Application Ser. No. 60/275,798 filed Mar. 14, 2001.

BACKGROUND OF THE INVENTION

1. Technical Field

The invention relates to saddlery and particularly to a saddle cinch having a buckle which permits easy adjustment of the cinch about the body of a horse to secure the saddle thereon.

2. Background Information

Most saddles are secured on a horse by means of a cinch or girth strap which is connected to both sides of the saddle and passes beneath the body of the horse. One side of the cinch is permanently or removably connected to one side of the saddle by a flexible strap with the other side being constructed to be removably attached to the saddle to enable the cinch to be placed about the body of the horse and then tightened. When the cinch strap is first tightened about the horses body, the horse will bloat in an attempt to resist the pressure of the tightened strap. This requires the cinch and connecting strap to be readjusted and tightened several times until the proper tension is reached on the cinch and connecting straps.

One type of cinch has a buckle on one end about which a strap is looped one or more times through the buckle and through an opening in the saddle such as provided by a D-ring, before securing the strap in an adjusted position by either a tongue on the buckle or by looping the strap about itself before being terminated in a locking loop. In those cinches having a buckle through which the strap makes several loops, it requires considerable pulling pressure by the horseman in order to tighten the cinch about the horse due to the leather strap being lopped upon itself resulting in a leather-to-leather sliding contact with the resultant large friction force occurring therebetween.

Therefore, the need exists for an improved cinch, and in particular a tightening and securement buckle therefore, which requires less force on the part of the horseman when tightening the cinch about the body of the horse to secure the saddle thereon.

SUMMARY OF THE INVENTION

The present invention provides a cinch and in particular a buckle therefore, for securing the saddle onto the body of the horse.

The cinch buckle of the invention comprises a rigid frame preferably having a trapezoidal configuration with a base bar, an intermediate bar and an outer end bar extending between a pair of sloped side frame members providing two strap receiving apertures therein for looping a tightening strap therethrough.

The cinch buckle of the invention further has a pair of rollers rotatably mounted on two of the buckle frame bars to reduce the sliding friction as the strap is looped and tightened about the intermediate and outer bars of the buckle.

Another aspect of the invention enables a locking tongue to be secured to the buckle by extending through a hole formed in the free end of the tightening strap to positively lock the strap in an adjusted position in the buckle.

Another feature of the invention is providing the cinch with a protective pad which extends beyond a pair of end buckles on the cinch to protect the horse's belly from contact with the metal buckles.

Still another feature of the invention is providing a method of easily tightening a cinch about the body of a horse to secure the saddle thereon by providing rolling friction instead of the heretofore leather-to-leather sliding friction as the cinch strap is tightened.

The foregoing advantages, construction and operation of the present invention will become more readily apparent from the following description and accompanying drawings.

BRIEF DESCRIPTION OF THE DRAWINGS

The preferred embodiment of the invention, illustrative of the best mode in which applicant contemplates applying the principles of the invention, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
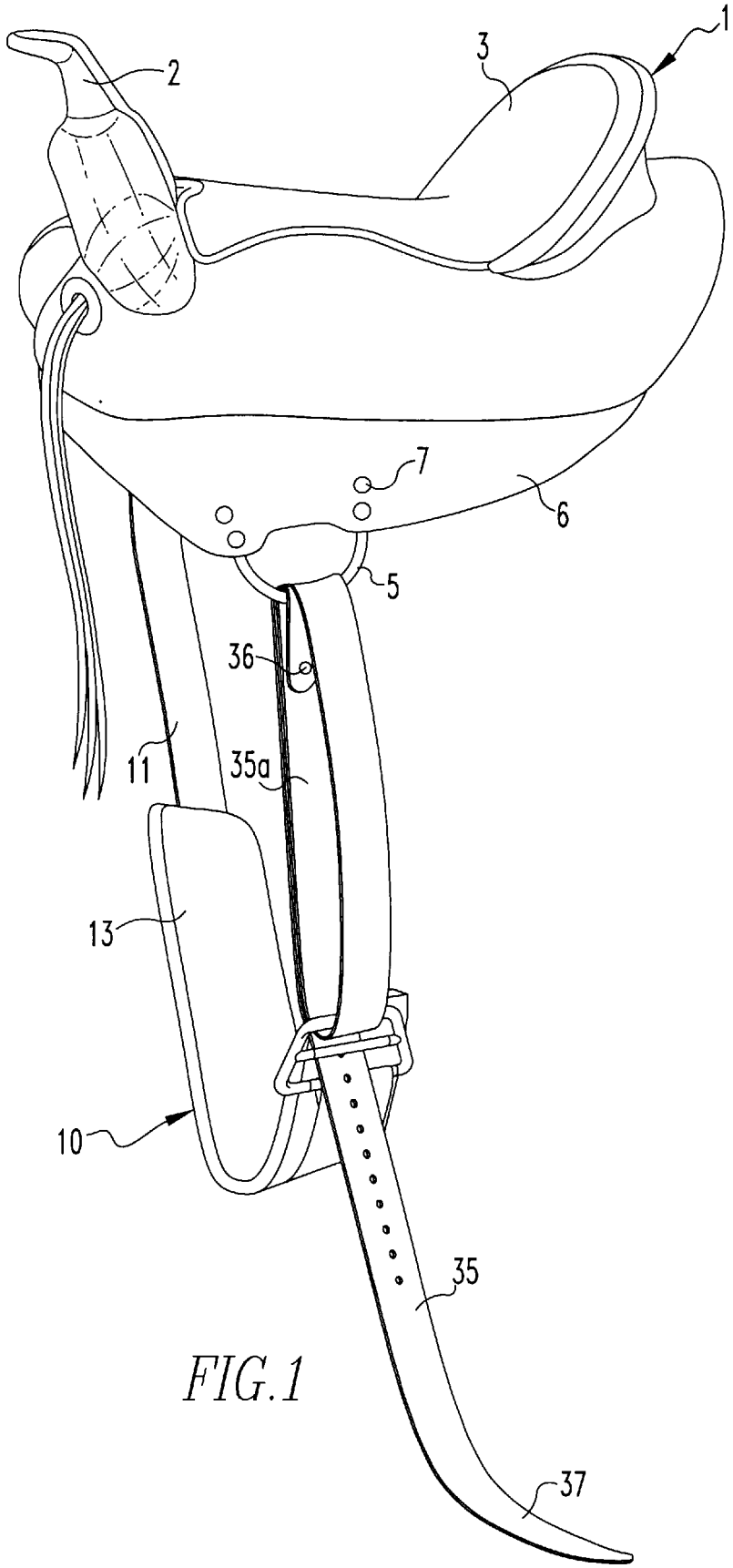
FIG. 1 is a perspective view of a saddle having a cinch with the unique buckle attached thereto partially secured to the saddle.

A usual type of riding saddle is shown in FIG. 1 and is indicated generally at 1. Saddle 1 is a western style saddle having a horn 2 and a relatively deep seat 3. However, the cinch buckle of the present invention is applicable to other types of saddles than that shown in FIG. 1 and need not be limited to western type saddles. Saddle 1 includes a D-ring 5 which is rigidly connected to the saddle apron 6 by rivets 7 or other type of connections. A cinch indicated generally at 10, is shown in detail in FIG. 2 and is connected by a strap 11 to one side of saddle 1 as shown in FIG. 1 by some type of attachment means either permanent or removable, such as a buckle or D-ring for a loop strap connection. Cinch 10 includes a protective pad 13 usually formed of felt or other type of soft material, to protect the underbelly of the horse and will have a short piece of flexible material or strap 14 secured to pad 13, having a usual buckle 15 permanently attached by a sewn hem 16 or the like at one end of strap 14.

Figure 2:
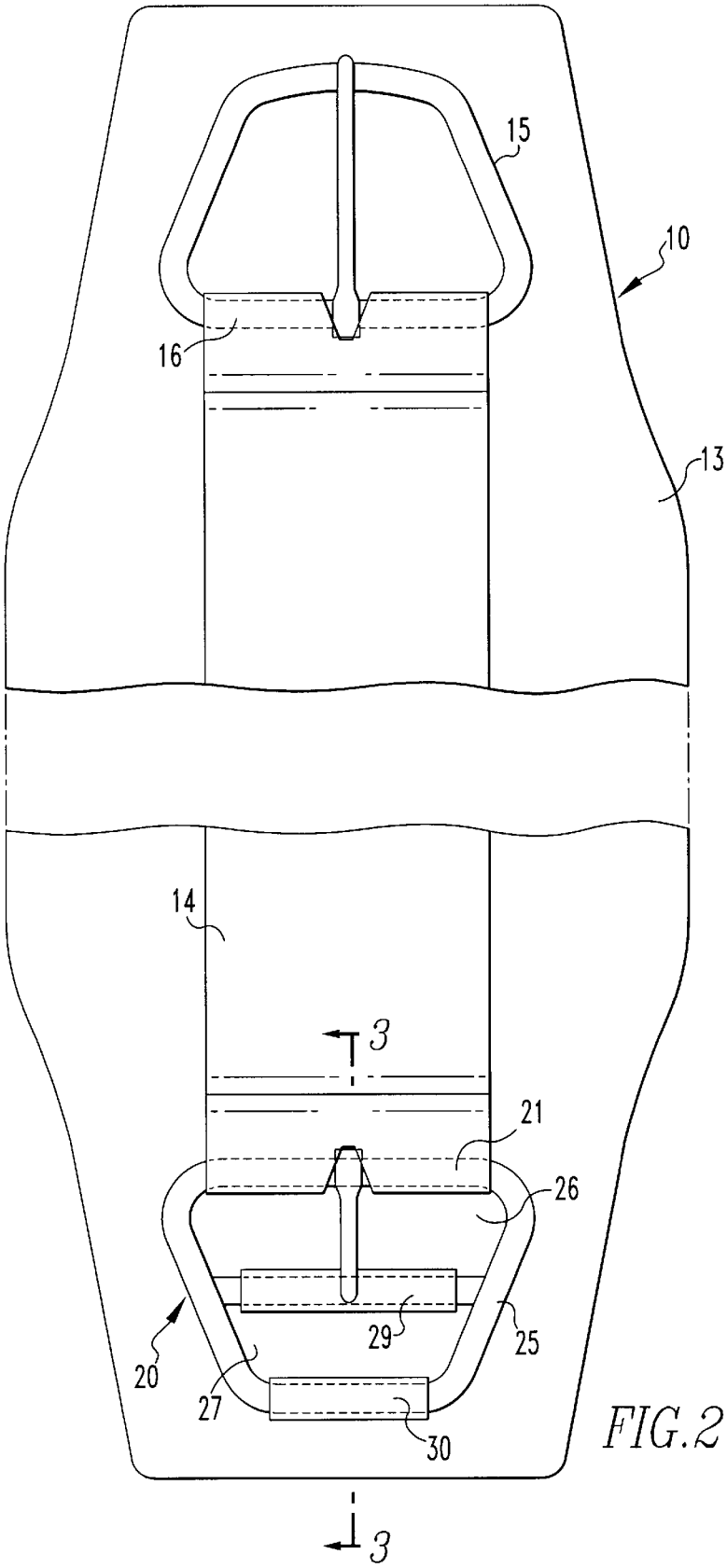
FIG. 2 is a fragmentary plan view of the cinch having the unique buckle of the present invention attached thereto.
Figure 3:
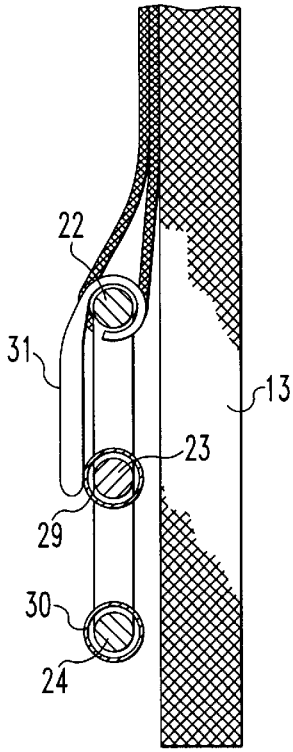
FIG. 3 is an enlarged fragmentary sectional view taken on line 3—3, FIG. 2.
Figure 4:
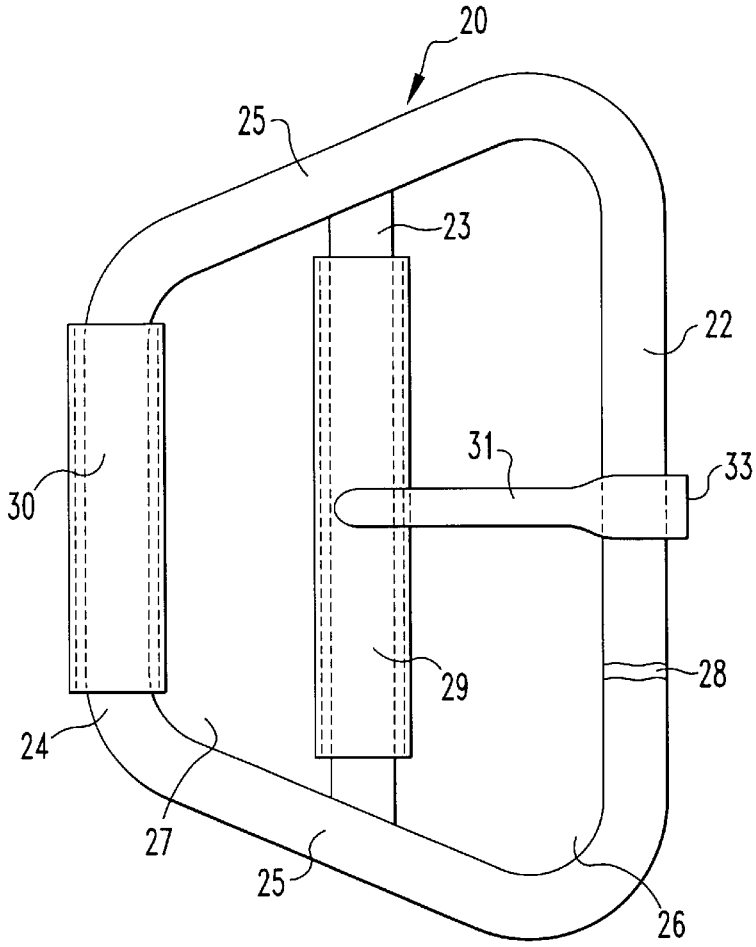
FIG. 4 is an enlarged plan view of the cinch buckle removed from the cinch.
Figure 5:
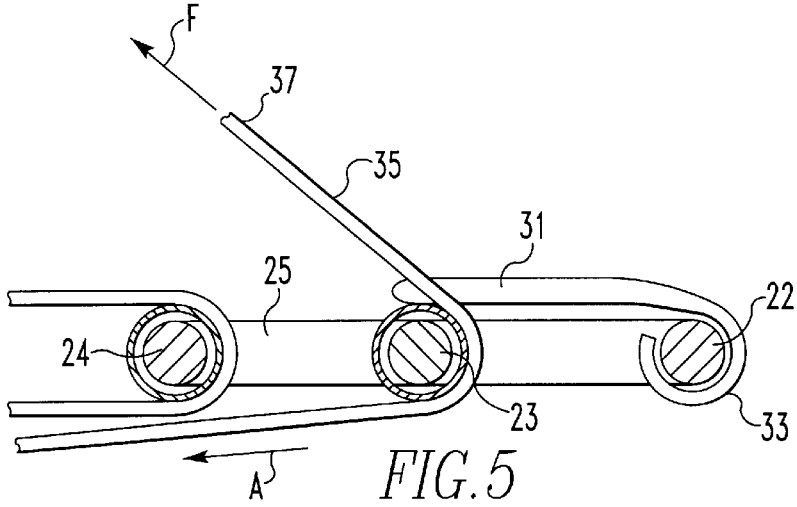
FIG. 5 is an enlarged fragmentary sectional view of the cinch buckle similar to FIG. 3 showing the tightening strap looped thereabout.

The improved cinch buckle of the present invention is indicated generally at 20, and is shown in FIG. 2 attached by a sewn hem 21 to strap 14 opposite of buckle 15. As shown in FIG. 4, cinch buckle 20 has a trapezoidal configuration with a base bar 22, an intermediate bar 23 and an outer end bar 24 all of which are connected or formed integrally with a pair of tapered side frame members 25. Bars 22, 23 and 24 preferably have a circular cross sectional configuration as shown in FIG. 5. If desired, outer frame members 25, end bar 24 and base bar 22 may be formed of a single piece of circular bar stocks secured together by a weld 28 with intermediate bar 23 being welded at the ends thereof to side frame members 25. Intermediate bar 23 forms a pair of apertures 26 and 27 with spaced bars 22 and 24 respectively. In further accordance with the invention, roller sleeves 29 and 30 are rotatably mounted on frame bars 23 and 24 respectively, so as to freely rotate thereon as best illustrated in FIG. 5. A locking tongue 31 is movably mounted on base bar 22 by a rolled end 33 formed thereon.

Figure 6:
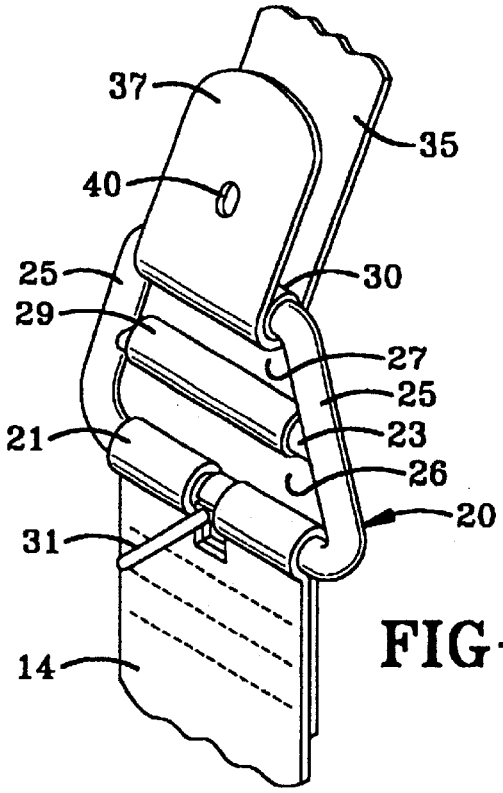
FIG. 6 is a diagrammatic perspective view showing the free end of the tightening strap inserted through the buckle at the start of the tightening procedure.
Figure 7:
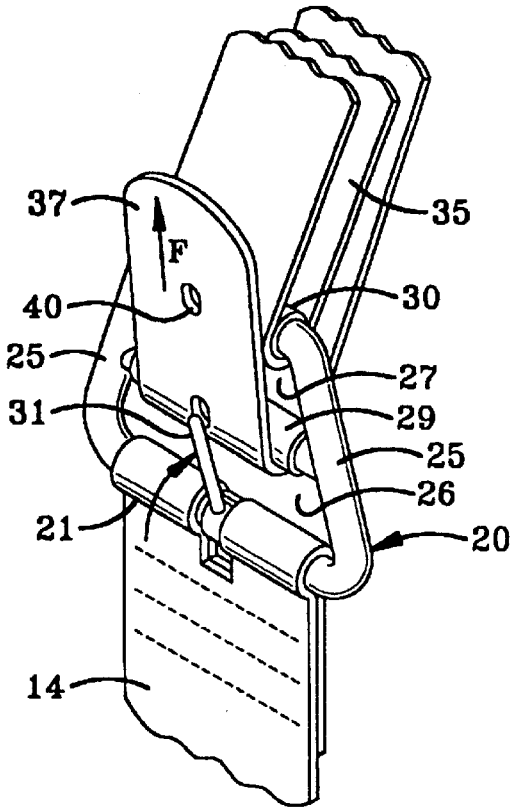
FIG. 7 is a view similar to FIG. 5 showing the continuation of the tightening strap being looped about the buckle and through the second strap receiving aperture formed therein.
Figure 8:
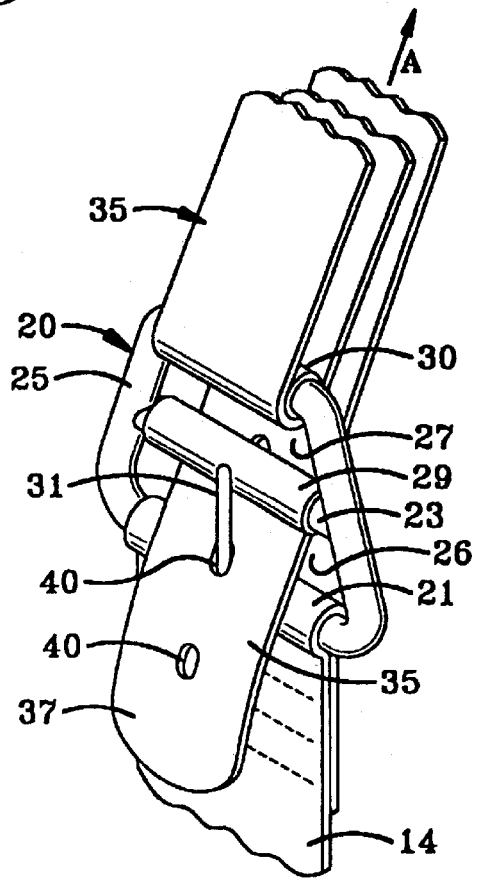
FIG. 8 is a view similar to FIGS. 6 and 7 showing the free end of the strap being secured in a fixed position on the cinch buckle.

The method of attaching saddle 1 to a horse and manner of use of the improved cinch buckle 20 is illustrated in FIGS. 6–8. Cinch pad 13 has been removed for clarity. An elongated strap 35 is secured to D-ring 5 such as by forming a loop at one end thereof and securing the same about ring 5 by rivets 7 (FIG. 1). Free end 37 is placed through buckle aperture 27 and formed into a loop about roller sleeve 30. Pulling upwardly on strap 35 will begin tightening cinch 10 about the horse's body. Free end 37 is then inserted through the opening of D-ring 5 as shown in FIG. 1, and down and along a strap portion 35*a* which extends between D-ring 5 and roller 30, and then through aperture 26 (FIG. 7). The horseman then pulls again in a generally upward direction as shown by arrow F which will roll the strap along roller sleeve 29 to tighten the cinch further around the horses body. The upward movement of strap 35 about sleeve 29 will also move the strap about roller sleeve 30 until the desired initial tension is placed on the cinch and strap 35. The free end of strap 35 will be pulled upward again to further tighten the cinch about the horses body. This tightening and retightening procedure may have to be repeated several times until the desired tension has been achieved on cinch 10 and straps 11 and 35 until the bloating of the horse has been overcome. However, each time an upward outward force is exerted on free end 37 of strap 35, the strap loops will roll along sleeves 29 and 30 avoiding the heretofore leather-on-leather or leather-to-metal friction around a frame bar as in prior cinch buckle constructions. After the desired tension has been reached, tongue 31 is then rotated until it extends through a selected hole 40 formed in strap 35 and is forced against intermediate bar 23 to lock the strap in its tightened position. The tension in the direction of arrow A on strap 35 as shown in FIG. 8, will securely clamp the tongue in this locked position.

Thus, it is readily seen that the cinch and connecting straps can be repeatedly tightened by pulling outwardly upwardly on free end 37 of strap 35 in a similar manner as with a usual buckle. However, the double looping of the strap about the two roller sleeves 29 and 30 considerably reduces the friction that must be overcome by the pulling force, enabling sufficient force to be applied to the cinch to tighten it about the horses body.

If desired, free end 37 of strap 35 could be looped through D-ring 5 and wrapped about the upper part of the triple thickness strap and tied off in a locking loop eliminating the need for tongue 31 without affecting the concept of the invention or preferred manner of use of buckle 20.

Accordingly, the improved cinch buckle and method of use is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the cinch buckle and method of use is constructed and used, the characteristics of the construction, and the advantageous new and useful results obtained; the new and useful structures, devices, elements, arrangements, parts, combinations and method steps are set forth in the appended claims.

What is claimed is:

1. A cinch and strap combination for securing a saddle on a horse comprising:

first and second elongated flexible straps;

a cinch including a flexible strip of material with a pair of buckles attached at opposite ends of said strip, one of said buckles being connected to the first strap;

the other of said buckles including a rigid frame having a base bar, an intermediate bar and an outer bar connected by sloped side frame members, said bars being generally parallel to each other and defining a pair of respective strap-receiving apertures between said intermediate bar and the base bar and outer bar, and a fastening tongue movably attached to the base bar and extending to the intermediate bar for extending through a hole in the second strap; and said second strap forming a first loop about the outer bar and a second loop about the intermediate bar.

2. The combination defined in claim 1 in which a roller sleeve is rotatably mounted on each of the intermediate and outer bars.

3. The combination defined in claim 2 in which each of the roller sleeves is a metallic cylinder loosely mounted concentrically about the intermediate and outer bars.

4. The combination of claim 1 in which both buckles have a fastener tongue selectively engaged in respective holes formed respectively in the first and second straps.

5. The combination defined in claim 1 in which a protective pad is secured to the flexible strip of material and extends beyond both buckles.

6. The combination defined in claim 1 in which the outer bar has a length, the intermediate bar has a length greater than the length of the outer bar, and the base bar has a length greater than the length of the intermediate bar.

7. The combination defined in claim 1 in which the frame has a trapezoidal configuration defined by the side frame members, the base bar and the outer bar.

8. The combination defined in claim 7 in which the outer bar has a length, the intermediate bar has a length greater than the length of the outer bar, and the base bar has a length greater than the length of the intermediate bar.

9. A method of securing a saddle on the body of a horse comprising the steps of:

a) providing a cinch having a buckle formed by a rigid frame having at least a base bar, an intermediate bar and an outer end bar forming first and second apertures within the frame on opposite sides of said intermediate bar;

b) providing a first flexible strap extending between and connected to the saddle and cinch;

c) providing a second flexible strap having first and second ends wherein said first end is secured to the saddle;

d) looping the second end of the second strap through the first aperture and around the outer end bar and back around through an opening on the saddle; then e) looping said second end of the second strap through the second aperture in the buckle frame and around the intermediate bar; and then f) pulling upwardly on said second end of the second strap to tighten the cinch about the body of the horse to secure the saddle thereon.

10. The method defined in claim 9 including the step of providing rollers on the intermediate and outer end bars of the buckle frame.

11. The method defined in claim 10 including the step of rotating the rollers when pulling on the second end of the second strap.

12. The method defined in claim 9 including the steps of providing a locking tongue on the base bar of the buckle frame and inserting said tongue through a hole formed in the second strap.

13. The method defined in claim 9 including the step of providing a D-hook on the saddle to form the saddle opening.

14. The method defined in claim 9 including the step of providing the cinch with a protective pad.

15. The method defined in claim 14 including the step of placing the protective pad between the body of the horse and the cinch and buckle to protect the body of the horse.

16. The method of claim 9 further including the step of passing the second end of the second strap around the first end of the second strap after looping the second strap through the first aperture and before looping the second strap through the second aperture.

17. The combination of claim 16 in which the frame is formed of metal.

18. A cinch and strap combination for securing a saddle on a horse comprising:

a first elongated flexible strap having first and second ends;

a cinch with a buckle attached at one end thereof;

the buckle having first and second sides and including a rigid frame having a base bar, an intermediate bar and an outer bar, said bars being generally parallel to each other and defining a first strap-receiving aperture between the intermediate bar and the outer bar and a second strap-receiving aperture between the intermediate bar and the base bar;

the first strap forming a first loop about the outer bar by inserting the second end of the first strap from the first side of the buckle through the first aperture and forming a second loop about the intermediate bar by inserting the second end of the first strap from the first side of the buckle through the second aperture; and a fastening means to selectively secure the first strap to maintain the first and second loops.

19. The combination of claim 18 further including a second strap connected to the other end of the cinch.

20. The combination of claim 19 further including a second buckle which connects the cinch and the second strap.

21. The combination of claim 18 wherein the first strap loops around the first end of the first strap.

22. The combination of claim 18 wherein the fastening means is a fastening tongue movably attached to the base bar and extending to the intermediate bar for extending through a hole in the second strap.

23. The combination of claim 18 wherein the second strap is tied off in a locking loop to provide the fastening means.

24. The combination of claim 18 in which a roller sleeve is rotatably mounted on each of the intermediate and outer bars.

25. The combination of claim 24 in which each of the roller sleeves is a metallic cylinder loosely mounted concentrically about the intermediate and outer bars.

26. The combination of claim 18 in which both buckles have a fastener tongue selectively engaged in respective holes formed respectively in the first and second straps.

27. The combination of claim 18 wherein the bars of the buckle are connected by frame members.

28. The combination of claim 27 wherein the side frame members are sloped.

29. The combination of claim 28 in which the frame has a trapezoidal configuration defined by the frame members, the base bar and the outer bar.

30. The combination defined in claim 29 in which the outer bar has a length, the intermediate bar has a length greater than the length of the outer bar, and the base bar has a length greater than the length of the intermediate bar.

31. A buckle and strap combination for securing a saddle on a horse, the combination comprising:

first and second elongated flexible straps; the second strap having first and second ends;

a buckle connected to one of the saddle and the first strap;

the buckle having first and second sides and including a rigid frame having a base bar, an intermediate bar and an outer bar, said bars being generally parallel to each other and defining a first strap-receiving aperture between the intermediate bar and the outer bar and a second strap-receiving aperture between the intermediate bar and the base bar;

the second strap forming a first loop about the outer bar by inserting the second end of the second strap from the first side of the buckle through the first aperture and forming a second loop about the intermediate bar by inserting the second end of the second strap from the first side of the buckle through the second aperture; and a fastening means to selectively secure the strap to maintain the first and second loops.

32. The combination of claim 31 wherein the fastening means is a fastening tongue movably attached to the base bar and extending to the intermediate bar for extending through a hole in the strap.

33. The combination of claim 31 wherein the second strap is tied off in a locking loop to provide the fastening means.

34. The combination of claim 31 wherein the first strap is connected to the saddle.

35. The combination of claim 31 wherein the first end of the second strap is connected to the other of the saddle and the first strap.

36. The combination of claim 31 further including an additional strap and wherein the first strap is a cinch connected to the additional strap.

37. The combination of claim 36 wherein the additional strap is connected to the saddle.

38. The combination of claim 36 wherein the cinch and the additional strap are connected by a second buckle.

39. The combination of claim 31 wherein the second strap loops around the first end of the second strap.

* * * * *